US007912242B2

(12) United States Patent
Hikichi

(10) Patent No.: US 7,912,242 B2
(45) Date of Patent: Mar. 22, 2011

(54) SPEAKER APPARATUS AND TERMINAL MEMBER

(75) Inventor: Toshihiro Hikichi, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1164 days.

(21) Appl. No.: 11/595,867

(22) Filed: Nov. 13, 2006

(65) Prior Publication Data

US 2007/0116323 A1 May 24, 2007

(30) Foreign Application Priority Data

Nov. 11, 2005 (JP) ..... 2005-327178

(51) Int. Cl.
*H04R 1/00* (2006.01)
*H04R 9/06* (2006.01)
*H04R 11/02* (2006.01)
*H04R 1/02* (2006.01)

(52) U.S. Cl. ..... 381/433; 381/394; 381/395; 381/396

(58) Field of Classification Search ..... 381/433
See application file for complete search history.

(56) References Cited

U.S. PATENT DOCUMENTS 4,068,103 A * 1/1978 King et al. ..... 381/409
6,876,753 B2 * 4/2005 Kim ..... 381/386

FOREIGN PATENT DOCUMENTS

JP 64-5436 2/1989
JP 06-014383 1/1994

* cited by examiner

*Primary Examiner* — Curtis Kuntz
*Assistant Examiner* — Matthew Eason
(74) *Attorney, Agent, or Firm* — Arent Fox LLP

(57) ABSTRACT

A frame has a slide hole and a receiving hole made close to an end of the slide hole. A terminal member has a protrusion protruding from a face making contact with the speaker frame, and a claw projecting in a direction approximately perpendicular to a protruding direction of the protrusion. An approximate-projection-shaped engaging portion is formed on the claw to engage with the receiving hole made close to the end of the slide hole. For example, when the terminal member is mounted on the frame, the protrusion is inserted into the slide hole and then slid along the slide hole, thereupon the engaging portion formed on the claw engages with the receiving hole, whereby the terminal member is fixedly attached to the speaker frame.

11 Claims, 11 Drawing Sheets

1j

6

200

SPEAKER APPARATUS AND TERMINAL MEMBER

BACKGROUND OF THE INVENTION

1. Field of the Invention

This invention relates to a speaker apparatus and a terminal member.

The present application claims priority from Japanese Application No. 2005-327178, the disclosure of which is incorporated herein by reference.

2. Description of the Related Art

FIG. 1 illustrates a conventional speaker apparatus 1*j* as disclosed in JP Patent H6-14383A. The speaker apparatus 1*j* is provided at its center with a center pole 2*j* made of a magnetic material. A yoke 3*j* including the center pole 2*j* is formed in an inverted T shape with a difference in level in cross section. A ring-shaped magnet 4*j*, which has a constant thickness, is provided on the circular side face of the yoke 3*j* at a fixed distance from the center pole 2*j* . A ring-shaped plate 5*j* is placed on the top face (in FIG. 1) of the magnet 4*j*. The yoke 3*j*, the magnet 4*j* and the plate 5*j* constitute a magnet circuit. A metal-made speaker frame 6*j*, which is provided on the plate 5*j*, is formed in a funnel shape having a flat portion 6A formed in part of it. A damper 7*j* is bonded to the flat portion 6A with an adhesive. An air space 8*j* is created between the center pole 2*j* and the inner peripheral face of the plate 5*j*. In the air space 8*j*, a cylindrical voice coil bobbin 9*j* is provided in the vicinity of the outer periphery of the center pole 2*j*, and a voice coil 10*j* is wound on the voice coil bobbin 9*j*. One end of the damper 7*j* is fixed to a portion of the side face of the voice coil bobbin 9*j* above the voice coil 10*j*, and also a diaphragm 11*j* is fixed at its one end to a higher portion of the voice coil bobbin 9*j* in FIG. 1. The other end of the diaphragm 11*j* is attached to the edge of the frame 6.

A terminal T as an external input terminal is placed on an extending portion 6B which extends continuously from the flat portion 6A toward the outside of the frame 6*j*. The terminal T is connected to one end of a lead wire K which is connected at the other end to the voice coil 10*j* through the diaphragm 11*j*, so that an audio signal received by the terminal T is sent through the lead wire K to the voice coil 10*j* . A dust-proof cap 13*j* is provided on the top face (in FIG. 1) of the voice coil bobbin 9*j*.

FIG. 2A is a perspective view of the conventional speaker apparatus 1*j* shown in FIG. 1. FIG. 2B is an enlarged view of the terminal T in FIG. 2A. In a typical speaker apparatus 1*j*, as illustrated in FIGS. 2A and 2B, the lead wire K and the extending portion 6B of the frame 6*j* are joined together through an eyelet 14*j*, provided on the extending portion 6B, by solder hd to form a terminal T. One end of the lead wire K is connected through the diaphragm 11*j* to the voice coil 19*j* and the other end thereof extends through the extending portion 6B.

JP Utility Model S64-5436B discloses an apparatus for fixedly attaching a speaker terminal plate to a frame. The apparatus has a frame including a raised member with a receiving hole and a guide groove, and also has a terminal plate having an engaging hook formed at its end. The terminal plate is fitted into the guide groove and the engaging hook is engaged with the receiving hole, in order to fix the terminal plate to the frame.

However, the manufacture of the speaker described in JP Patent H6-14383A needs complicated steps in which the extending portion 6B is formed on the flat portion 6A of the frame and then the terminal T is formed on the extending portion 6B. The manufacture of the apparatus described in JP Utility Model S64-5436B needs steps of forming the raised member having the engaging hole and further the guide groove in the speaker frame, and additionally complicated attaching steps in which the terminal plate is inserted into the guide groove and the engaging hook is engaged with the receiving hole. For these reasons, it is desired that a speaker apparatus should have a more simple structure and offer improved workability in the mounting process.

SUMMARY OF THE INVENTION

It is an object of the present invention to address these problems. In particular, it is an object of the present invention to provide a speaker apparatus equipped with a terminal member having a simple structure and improved in workability of a mounting process thereof.

For this object, the present invention provides at least the following structure.

An aspect of the present invention provides a speaker apparatus comprising a speaker frame and a terminal member mounted on the speaker frame. The speaker frame has a slide hole and a receiving hole bored close to an end of the slide hole. The terminal member has a protrusion protruding from a contact face making contact with the speaker frame, and a claw protruding in a direction approximately at a right angle to a protruding direction of the protrusion. The claw has an engaging portion formed in an approximate projection shape to engage with the receiving hole formed close to the end of the slide hole.

Another aspect of the present invention provides a terminal member mounted on a receiving member by use of a slide hole bored in the receiving member. The terminal member comprises a protrusion protruding from a contact face making contact with the receiving member, and a claw formed in a direction approximately at a right angle to a protruding direction of the protrusion. The claw comprises an engaging portion that is formed in an approximate projection shape to engage with a receiving hole formed close to an end of the slide hole.

In an exemplary embodiment of such a speaker apparatus according to the present invention, a speaker apparatus comprises a speaker frame and a terminal member mounted on the speaker frame. The speaker frame has a slide hole and a receiving hole bored close to an end of the slide hole. The terminal member has a protrusion protruding from a contact face making contact with the speaker frame, and a claw protruding in a direction approximately at a right angle to a protruding direction of the protrusion. The claw has an engaging portion formed in an approximate projection shape and engaging with the receiving hole made close to the end of the slide hole.

In the speaker apparatus according to the present invention, the protrusion of the terminal member is inserted into the slide hole, and then the terminal member is slid along the slide hole. Then, the approximate-projection-shaped engaging portion formed on the claw engages with the receiving hole made close to the end of the slide hole, thus fixedly attaching the terminal member to the speaker frame. In consequence, it is possible to provide a speaker apparatus equipped with a terminal member having a simple structure and improved in workability of a mounting process thereof.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

A speaker apparatus according to an embodiment of the present invention will be described below with reference to the accompanying drawings.

Figure 1:
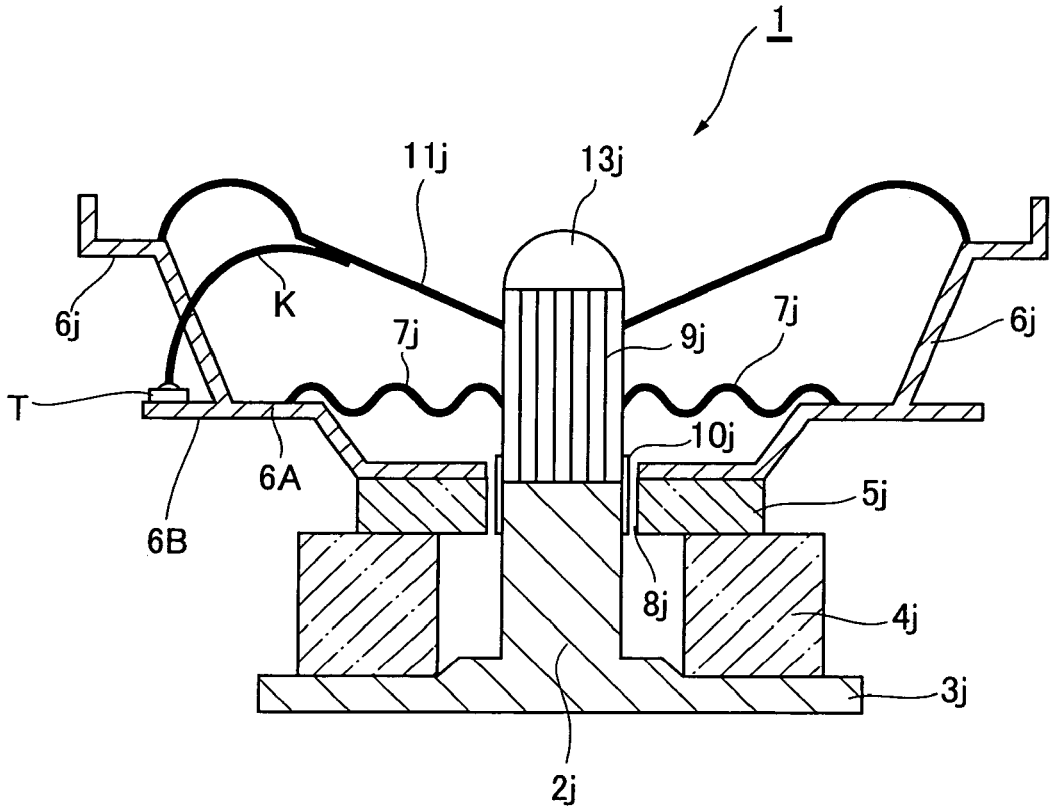
FIG.1 PRIOR ART
FIG. 1 is a sectional view illustrating a conventional speaker apparatus.
Figure 2A:
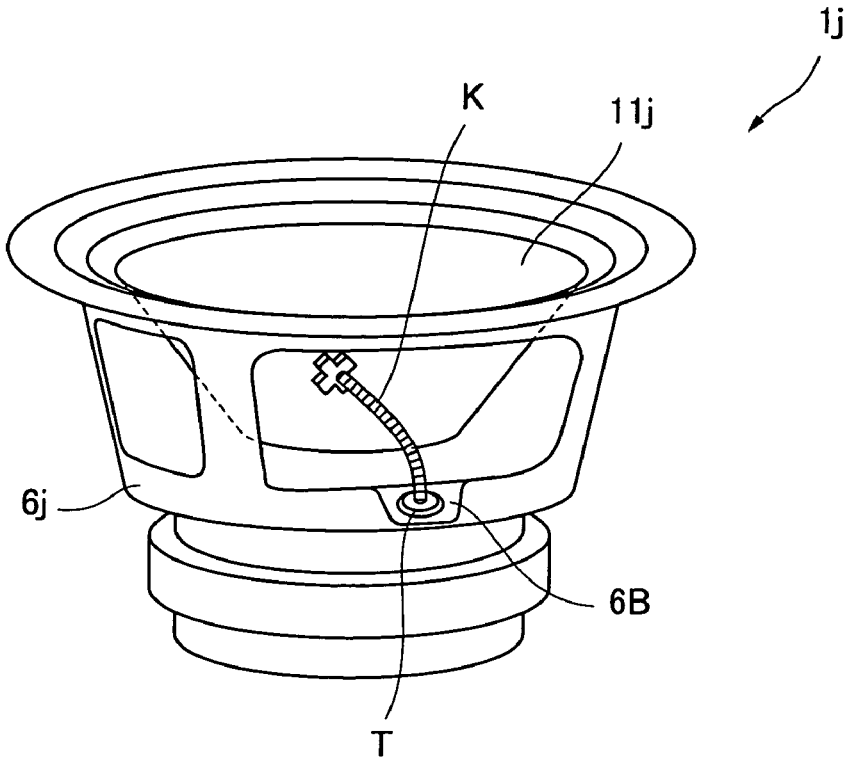
FIG.2 A PRIOR ART
FIG. 2A is a perspective view of the conventional speaker apparatus shown in FIG. 1.
Figure 2B:
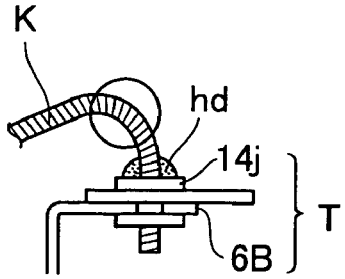
FIG.2 B PRIOR ART
FIG. 2B is an enlarged-sectional view of a terminal member T shown in FIG. 2A.
Figure 3:
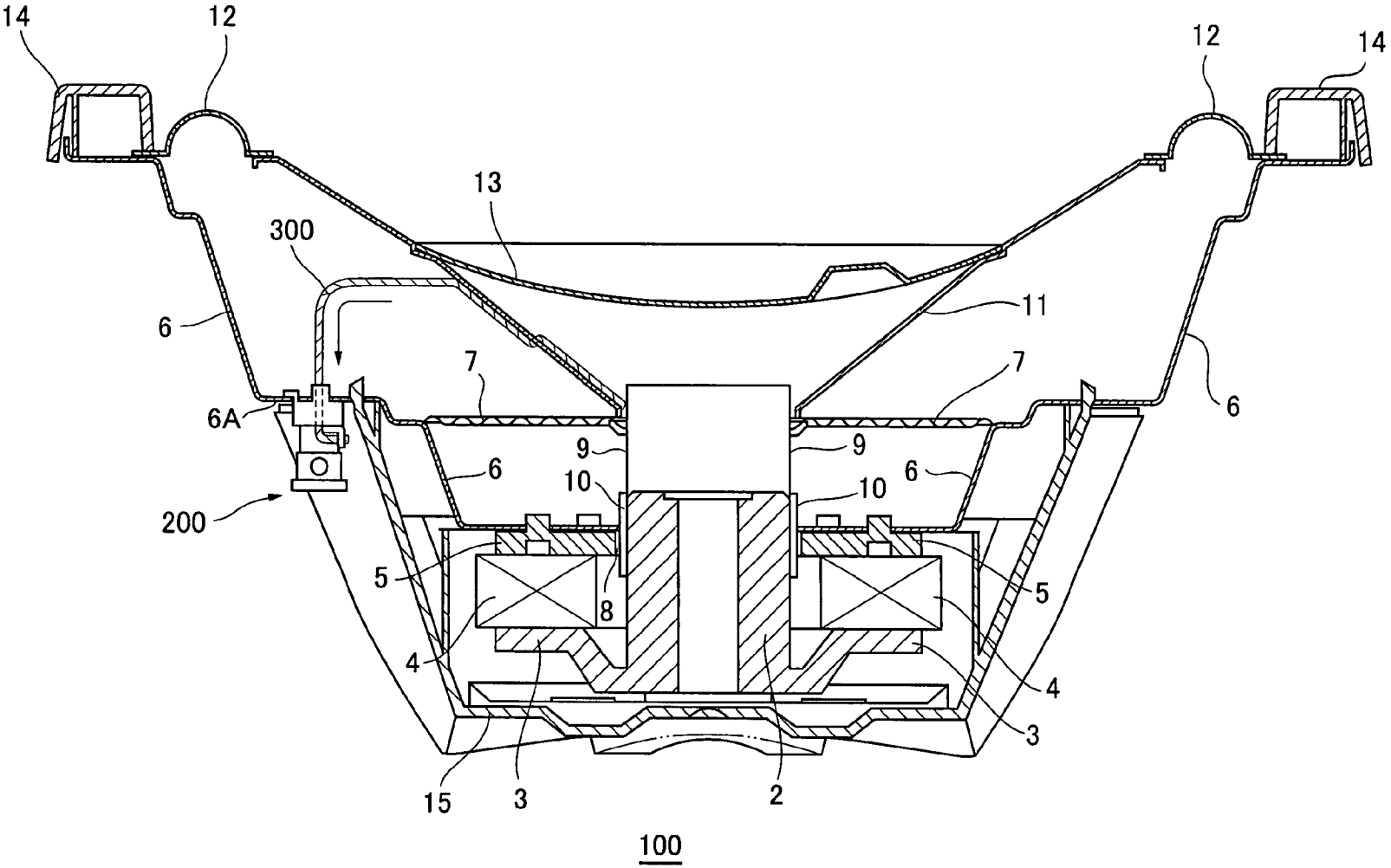
FIG. 3 is a sectional view illustrating a speaker apparatus according to an embodiment of the present invention.
Figure 4:
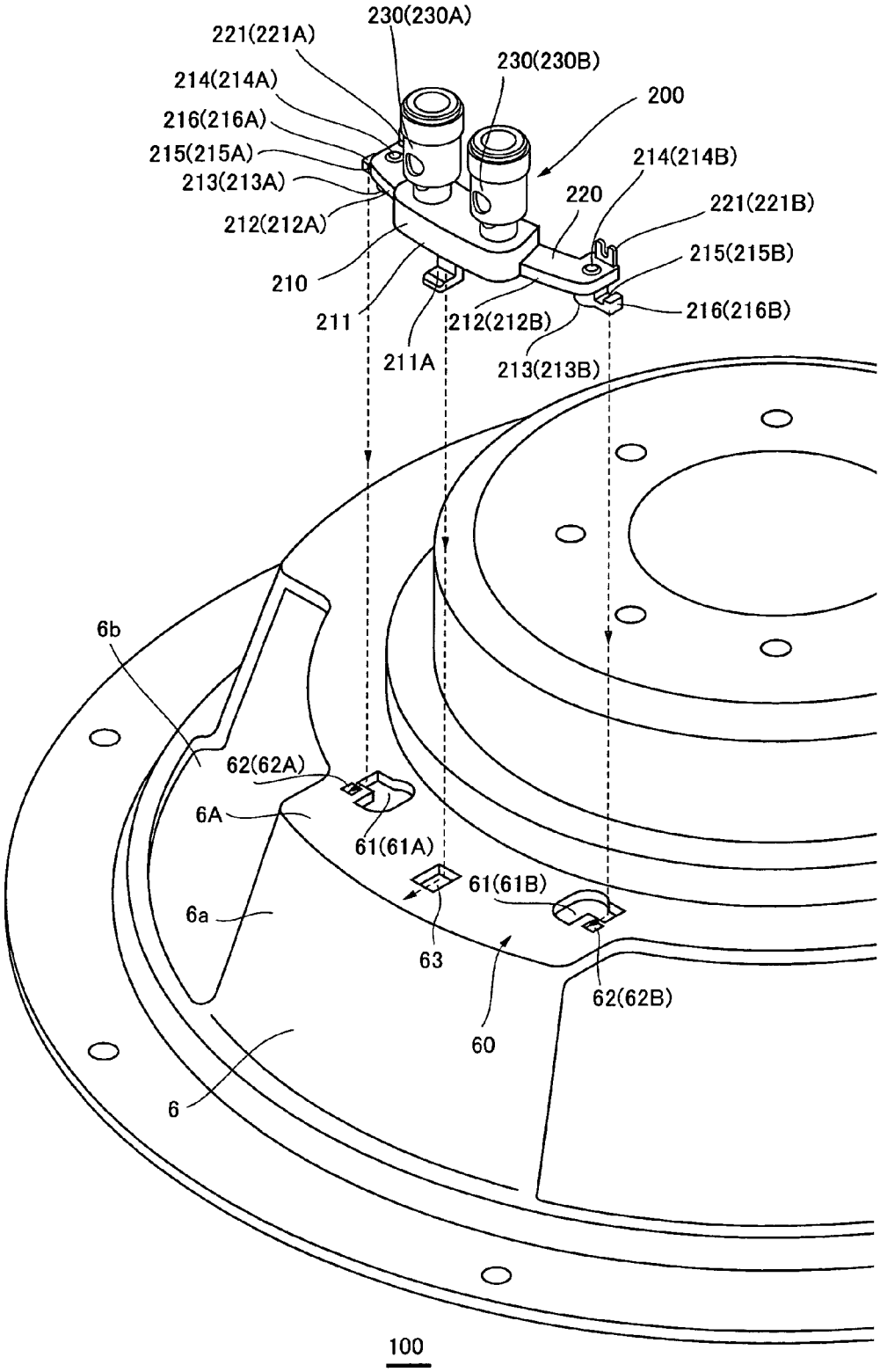
FIG. 4 is a perspective view illustrating a neighborhood of the terminal member of the speaker apparatus shown in FIG. 3.

FIG. 3 is a sectional view illustrating the speaker apparatus according to an embodiment of the present invention, and FIG. 4 is a perspective view illustrating a terminal member and the area around it to provide an explanation of the speaker apparatus in FIG. 3. A speaker apparatus 100 according to the present embodiment has a center pole 2, a yoke 3, a magnet 4, a plate 5, a speaker frame 6, a damper 7, a voice coil bobbin 9, a voice coil 10, a diaphragm 11, an edge 12, a cap 13, a outer frame (speaker grille) 14, a terminal member 200 and a lead wire 300. The speaker frame 6 includes a receiving member of the terminal member 200 according to the present invention.

The speaker apparatus 100 of the present embodiment is provided with the magnetic-material-made center pole 2 at its center. The yoke 3 including the center pole 2 has an inverted T shape with a difference in level in cross section. The ring-shaped magnet 4, which has a constant thickness, is provided on the circular side face of the yoke 3 at a fixed distance from the center pole 2. The ring-shaped plate 5 is placed on the top face of the magnet 4 as shown in FIG. 3. The yoke 3, the magnet 4 and the plate 5 constitute a magnetic circuit.

The frame 6 provided on the plate 5 is formed in a funnel shape with a flat portion 6A formed in part of it. The damper 7 is bonded to the flat portion 6A with an adhesive, for example. An air space 8 is created between the center pole 2 and the inner peripheral face of the plate 5. In the air space 8, the cylindrical voice coil bobbin 9 is provided in the vicinity of the outer periphery of the center pole 2, and the voice coil 10 is wound on the voice coil bobbin 9. The damper 7 is fixedly attached at its one end to a portion of the side face of the voice coil bobbin 9 above the voice coil 10, and also the diaphragm 11 is fixedly attached to a higher portion of the voice coil bobbin 9 as shown in FIG. 3. The outer peripheral end of the diaphragm 11 is attached via the edge 12 to the frame 6, with allowance for vibration. The dust-proof cap 13 is provided on the top face of the voice coil bobbin 9. The outer frame (speaker grille) 14 is provided on the front and outer end of the frame 6. A protective member 15 is provided on the rear (back face) of the speaker apparatus 100 so as to cover the magnetic circuit.

The terminal member 200 is mounted on the flat portion 6A of the frame 6. The lead wire 300 is electrically connected at one end to the terminal member 200, and at the other end to the voice coil 10 placed inside the frame 6 through the diaphragm 11.

The terminal member 200 according to the present embodiment is fabricated independently of the frame 6, and is then attached to the frame 6. The frame 6 and the terminal member 200 have a fixing structure with each other, respectively, as described later. In the mounting process, the terminal member 200 and the frame 6 are fixedly joined together by the fixing structure. The provision of the fixing structure according to the present invention prevents the terminal member 200 from being removed from the frame 6 by an external force or the like. The frame 6 and the terminal member 200 will be described in detail later.

[Speaker Frame 6]

Figure 5:
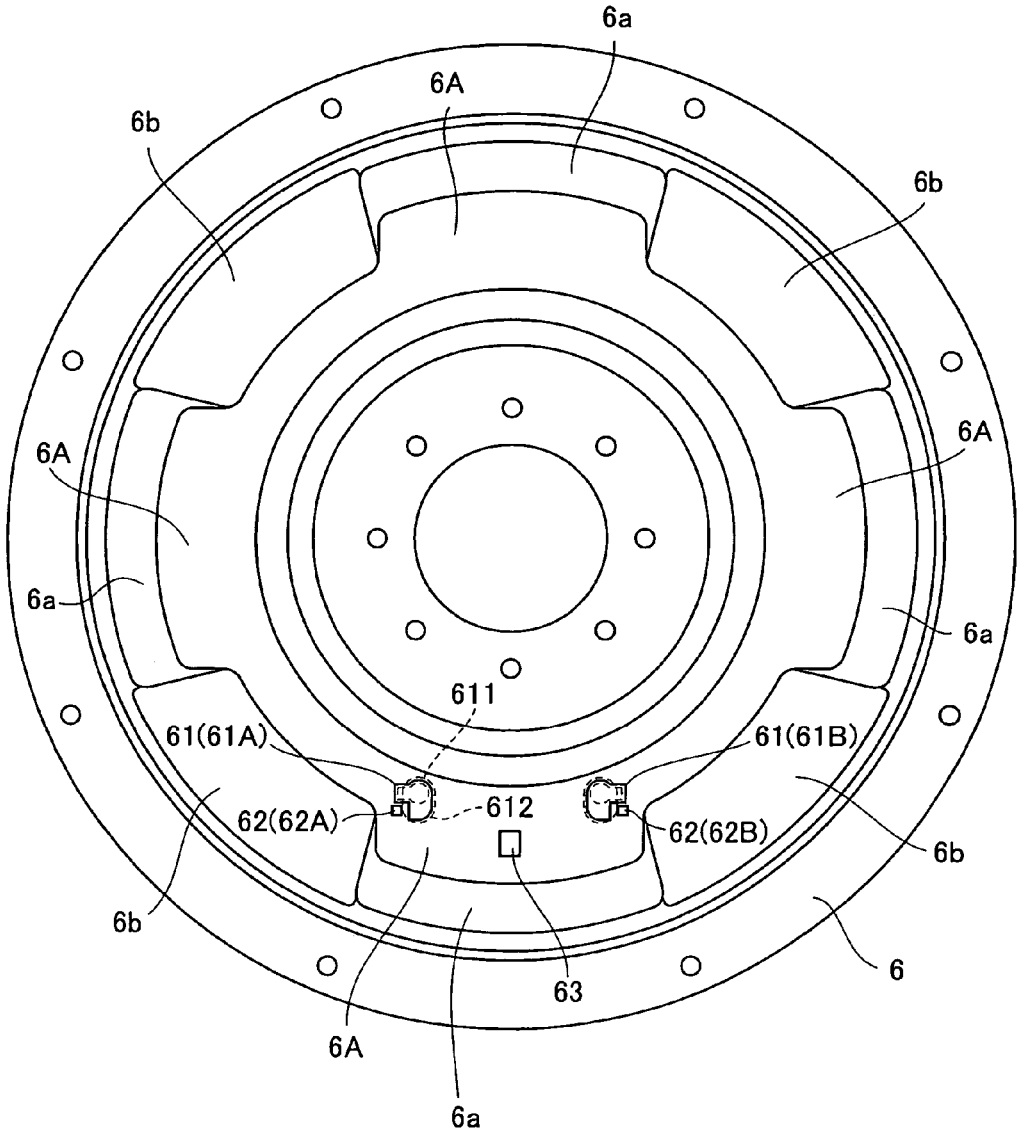
FIG. 5 is a bottom plan view illustrating a speaker frame of the speaker apparatus shown in FIG. 3.
Figure 6:
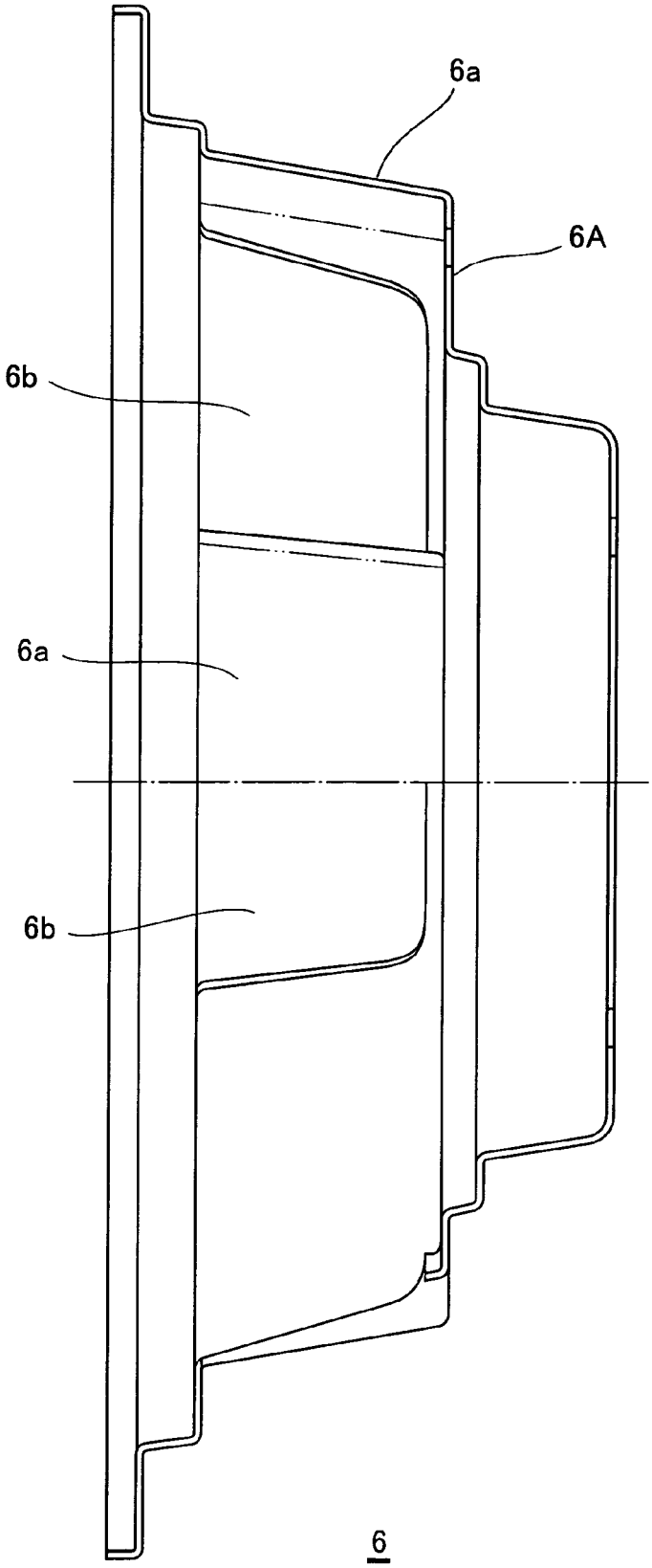
FIG. 6 is a partially sectional view of the speaker frame shown in FIG. 5.

FIG. 5 is a back view for illustrating the speaker frame of the speaker apparatus shown in FIG. 3. FIG. 6 is a partially sectional view of the speaker frame shown in FIG. 5.

As illustrated in FIG. 3 to FIG. 6, the frame 6*h* as a plurality of frame arms 6*a* supporting the diaphragm 11 and the like, and a plurality of open-type frame-openings 6*b*. The frame 6 in the present embodiment has four frame arms 6*a* and four frame-openings 6*b* as shown in FIG. 5. The terminal member 200 is mounted on at least one of the frame arms 6*a*. Specifically, the frame 6 has the flat portion 6A formed in the vicinity of the central portion of the frame arm 6*a*, and the terminal member 200 is mounted on the flat portion 6A.

A receiving hole portion 60 in which the terminal member 200 is mounted is formed in the flat portion 6A of the frame 6. More specifically, the receiving hole portion 60 is formed in a position corresponding to the protruding portion of the terminal member 200.

The receiving hole portion 60 is constituted of a plurality of holes, for example, slide holes 61, receiving holes 62 formed close to the ends of the respective slide holes 61, and a third slide hole 63.

For example, as illustrated in FIGS. 4 and 5, the receiving hole portion 60 has a first slide hole 61A, a second slide hole 61B, a first receiving hole 62A, a second receiving hole 62B, and a third slide hole 63. The slide holes 61 (61A, 16B) represent an embodiment of the slide hole according to the present invention. The receiving holes 62 (62A, 62B) represent an embodiment of the receiving hole according to the present invention.

Each of the slide holes 61 receives a protrusion of the terminal member 200. The slide hole 61 has a first hole 611 and a second hole 612, which are connected to each other, as shown in FIG. 5. Specifically, the first hole 611 is formed in a shape into which the protrusion 213 and a claw 215 of the terminal member 200 are inserted as described later. The second hole 612, which extends continuously from the first hole 611, has the long axis direction restricted in the sliding direction of the terminal member 200 with the insertion of the protrusion 213, and has approximately the same width as that of the protrusion 213.

Each of the receiving holes 62 is formed in the vicinity of the end of the slide hole 61, which specifically is formed close to the end of the second hole 612. As described later, the receiving hole 62 engages with an engaging portion 216 formed on the claw of the protrusion of the terminal member 200.

The third slide hole 63 engages with a protrusion (third claw) 211A formed on the terminal member 200 when the terminal member 200 is slid and fastened as described later. Each of the structural components will be described in detail later.

[Terminal Member 200]

Figure 7A:
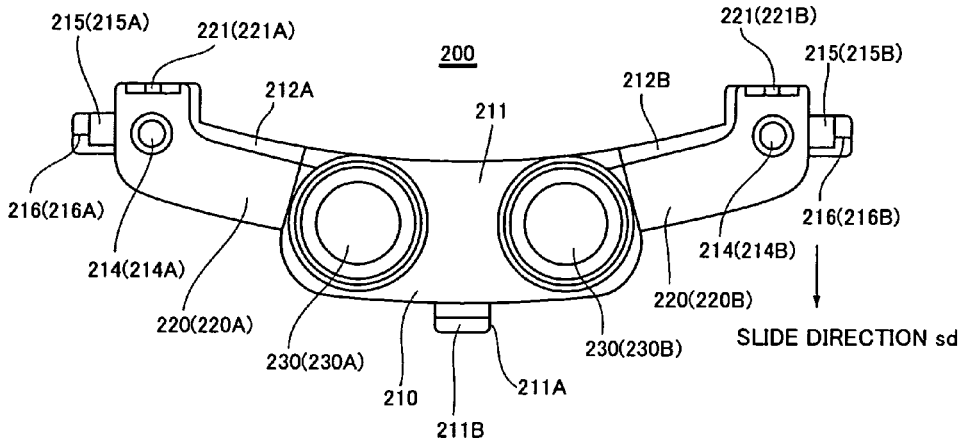
FIG. 7A is a top plan view illustrating the terminal member of the speaker apparatus shown in FIG. 3.
Figure 7B:
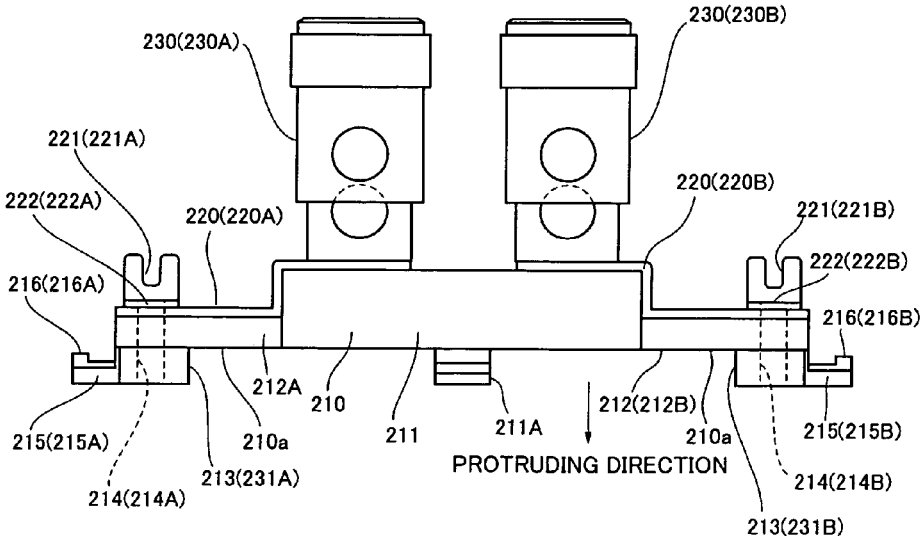
FIG. 7B is a front view of the terminal member in FIG. 7A.
Figure 7C:
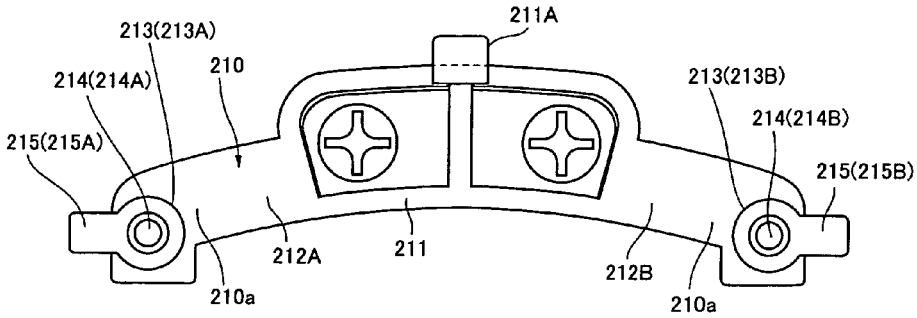
FIG. 7C is a rear view of the terminal member in FIG. 7A.
Figure 8:
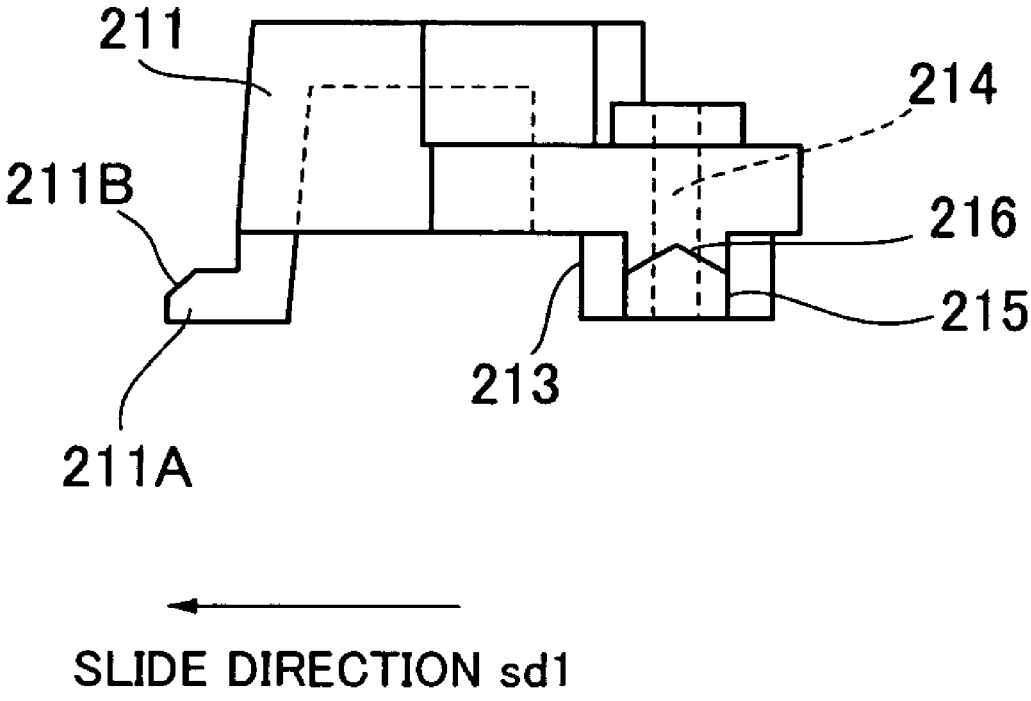
FIG. 8 is a side view of the terminal member in FIG. 7A.
Figure 9:
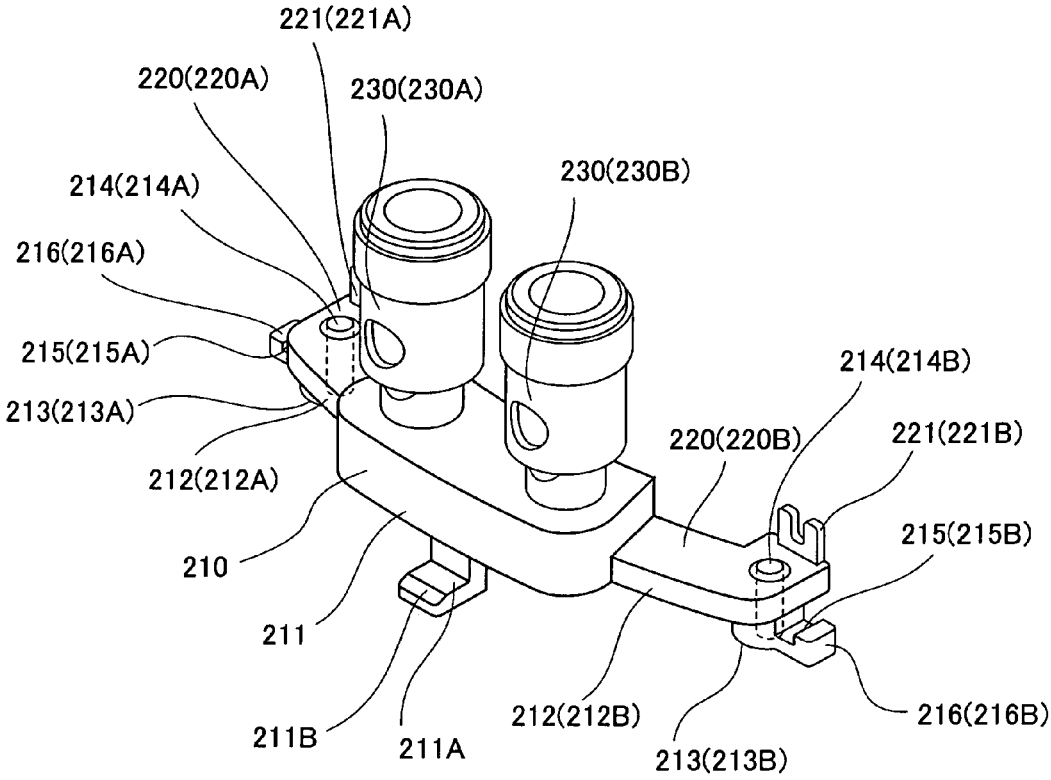
FIG. 9 is a perspective view of the terminal member in FIG. 7A.

FIGS. 7A to 7C illustrate the terminal member of the speaker apparatus shown in FIG. 3. FIG. 7A is a top plan view of the terminal member, FIG. 7B is a front view thereof, and FIG. 7C is its rear view. FIG. 8 is a side view of the terminal member shown in FIGS. 7A to 7C. Further, FIG. 9 is a perspective view of the terminal member shown in FIGS. 7A to 7C. The terminal member will be described below with reference to FIGS. 7A to 9.

The terminal member 200 is attached to the frame 6 as described above. The terminal member 200 has a base member (substrate) 210, terminal plates 220 and connectors 230.

The base member 210 is formed in an approximate flat-plate shape, for example. Specifically, the base member 210 has a central base 211, and arms 212 (212A, 212B) respectively extending outward from the central base 211 in opposite longitudinal directions. More specifically, the central base 211 is formed in an approximate trapezoid shape, and the connectors 230 are provided on the central base 211. The central base 211 has a claw 211A extending outward from the face 210*a* making contact with the speaker frame. The claw 211A is formed in an approximate L shape curving in the slide direction sd1. A tapered face 211B is formed on the upper face of the end of the claw 211A as shown in FIG. 9.

Each of the arms 212 (212A, 212B), which respectively extends outward from the central base 211 in the opposite longitudinal directions, has a protrusion 213 protruding in the vicinity of the end thereof from the face 210*a* making contact with the speaker frame. Specifically, the first protrusion 213A is formed on the first arm 212A and the second protrusion 213B is formed on the second arm 212B.

The protrusions 213 (213A, 213B) are formed in an approximately tubular shape and through holes 214 (214A, 214B) are respectively formed in the vicinity of central portions of the tubular shapes. As described later, the lead wire 300, which is connected at one end to the voice coil 10 placed inside the frame 6 and at the other end to the terminal member 200 mounted on the outside of the frame 6, is led out through the through hole 214 and then connected to the terminal member 200.

The claw 215 is formed on each of the arms 212 (212A, 212B) and extends out in a direction approximately perpendicular to the protruding direction of the protrusion 213. Specifically, as illustrated in FIG. 7A to FIG. 9, the first protrusion 212A includes the first claw 215A of the shape protruding in a direction approximately perpendicular to the slide direction, and the second protrusion 212B includes the second claw 215B of the shape protruding in the direction approximately opposite to the extension of the first claw 215A. The first claw 215A and the second claw 215B respectively extend from the side faces of the protrusions 213 in opposite directions (toward the outside of the terminal member 200).

Each of the claws 215 is provided with an engaging portion 216 engaging with the receiving hole 62 of the frame 6. The engaging portion 216 in the present embodiment is formed in an approximate upwardly-directed projection shape (in FIG. 7A) and approximately close to the end of the claw 215, for example.

For the base member 210, the structural components (e.g., the central base 211, the arms 212, the protrusions 213, the through holes 214, the claws 215 and the engaging portions 216) are integrally formed with the same materials. Various flexible materials such as elastomer, rubber or a resin material can be desirably used to form the base member 210.

Each of the terminal plates 220 is formed, for example, of a metal material, and provides electrical connection between the lead wire 300 led out to the rear face and the connector 230. The terminal plate 220 has an anchor 221 allowing for the fixed attachment of the lead wire 300. What is required is for the anchor 221 to reliably hold the lead wire 300, and therefore the shape and the like of the anchor 221 are not limited specially. The anchor 221 in the present embodiment is formed close to the end of the terminal plate 220 as an approximate U-shaped raised portion as shown in FIG. 7B, for example. The lead wire 300 is fitted into the U-shaped recess and then soldered thereto so as to be joined to the anchor 221. The terminal plate 220 has a through hole 222 bored in axis alignment with the through hole 214 of the base member 210. The lead wire 300 is inserted through the through holes 222 and 214.

When the two connectors 230 (230A, 230B) are provided, the terminal plate 220 is divided into two terminal plates 220A and 220B respectively connected to the connectors 230A and 230B. The terminal plate 220A has the anchor 221A formed thereon and the through hole 222A formed therein, and the terminal plate 220B has the anchor 221B formed thereon and the through hole 222B formed therein.

The connector 230 has one end connectable to a speaker cable or the like which is connected to external equipment, such as an amplifier, for sending an audio signal to the speaker apparatus, for example. The connector 230 is placed on the outside of the frame 6. The connector 230 is constituted of a push terminal or a screw terminal, for example. The connector 230 in the present embodiment is constituted of a push terminal. The type of the connector 230 is not limited to the above types. For example, the connector 230 may be constituted of any of a spade terminal, a fast-on terminal and a bullet terminal. Alternatively, the connector 230 may have the socket plug-in structure.

[Operations for Mounting the Terminal Member 200]

Figure 10:
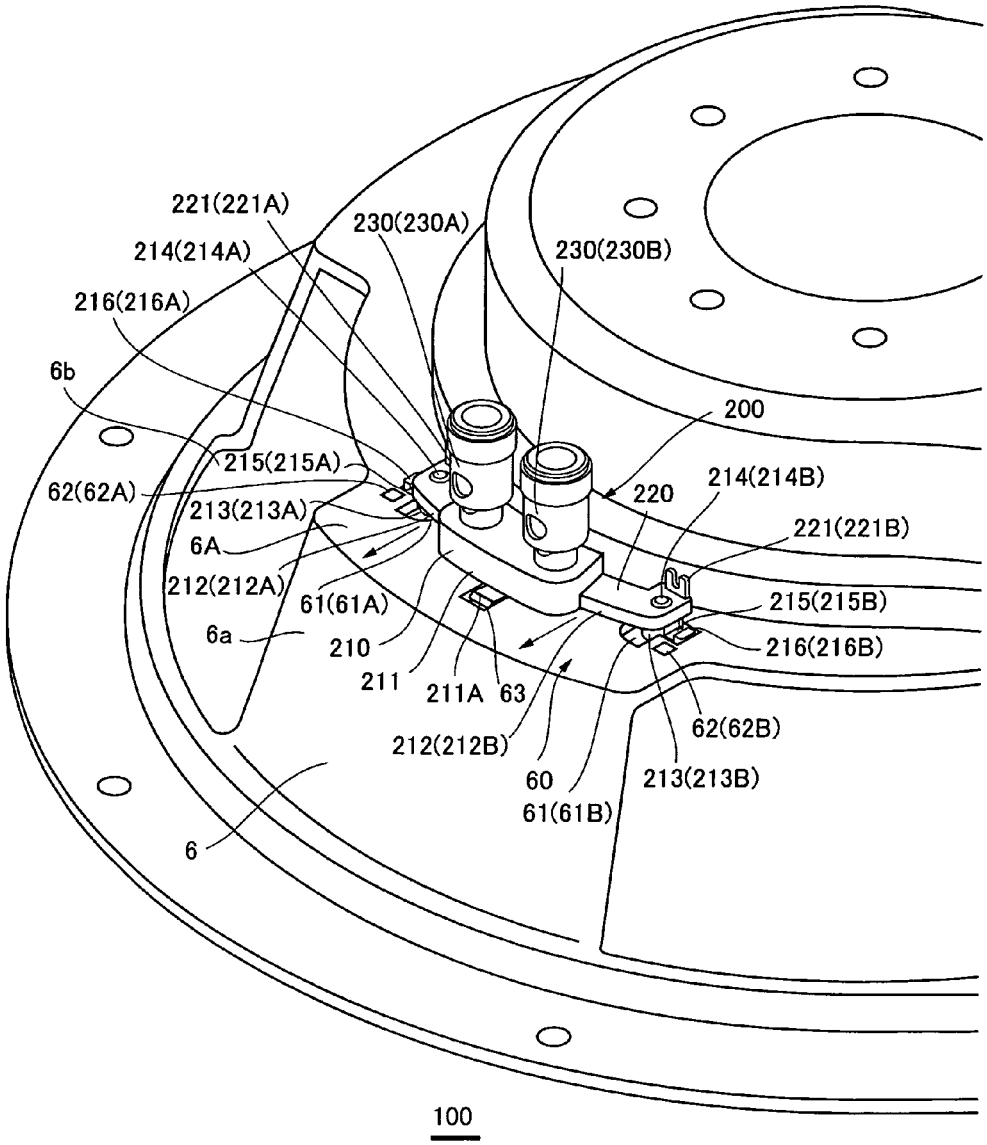
FIG. 10 is an explanation view illustrating a mounting operation of the terminal member in the speaker apparatus shown in FIG. 4.
Figure 11:
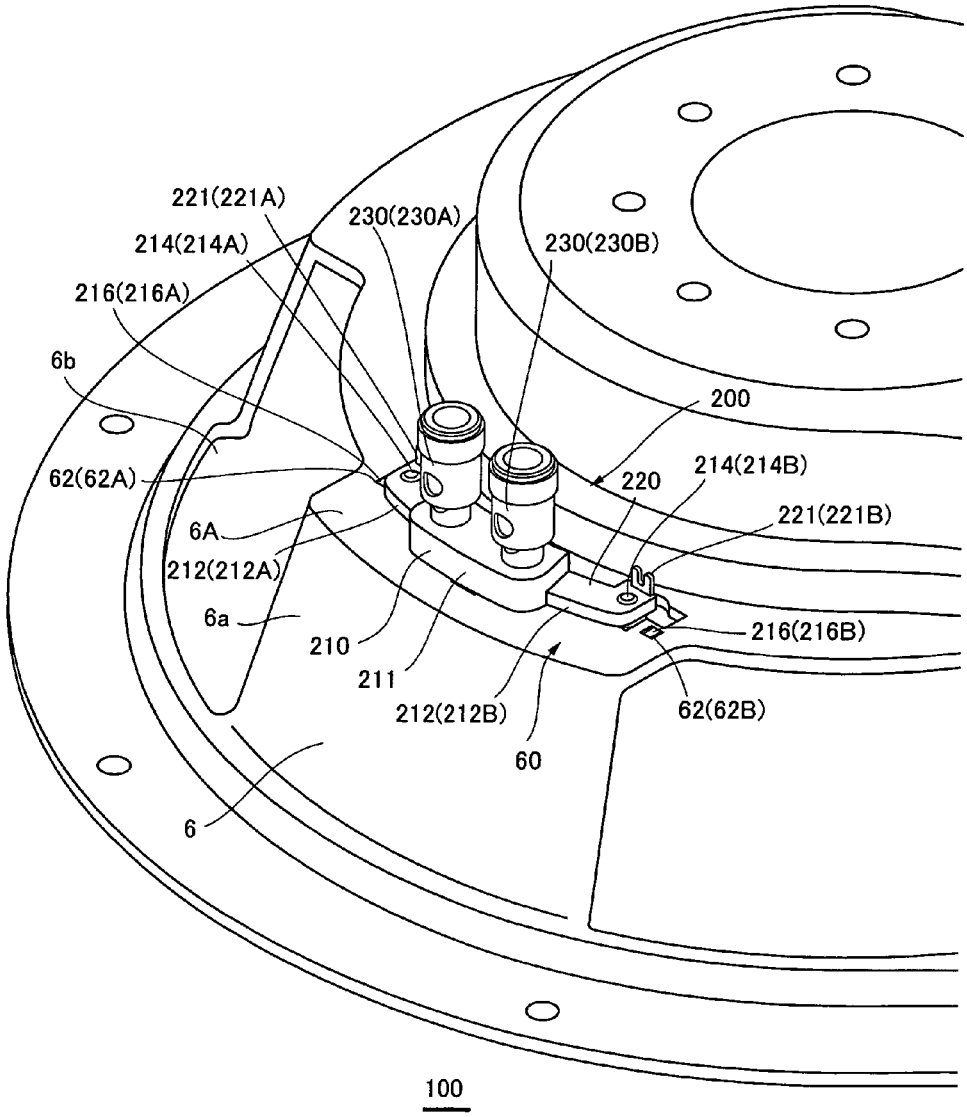
FIG. 11 is the further explanation view illustrating the mounting operation of the terminal member shown in FIG. 4.

FIG. 10 and FIG. 11 illustrate the operations of fabricating the speaker apparatus 100 shown in FIG. 4. A description will be given of the operations of fabricating the speaker apparatus of the above-described structure, in particular, the operations of mounting the terminal member 200 on the speaker frame 6, with reference to FIG. 4 to FIG. 11.

First, the positional relationship between the frame 6 and the terminal member 200 is determined such that the mounted hole portion 60 formed in the flat portion 6A on the rear face of the frame 6 is aligned with the protruding portion of the terminal member 200, as shown in FIG. 4. Specifically, the position relationship of the terminal member 200 is determined such that the first protrusion 213A, the second protrusion 213B and the third claw 211A are respectively aligned with the first slide hole 61A, the second slide hole 61B and the third slide hole 63.

Then, as shown in FIG. 10, the protrusions 213A, 213B and the third claw 211A are respectively fitted into the first slide hole 61A, the second slide hole 61B and the third slide hole 63. Then, as shown in FIG. 11, the terminal member 200 is slid along the slide hole (outward in the radial direction of the frame 6) while the protrusions 213A, 213B and the third claw 211A are inserted into the slide holes 61A, 61B and the third slide hole 63.

After the terminal member 200 has been slid, the approximate-projection-shaped engaging portions 216A, 216B formed on the claws 215A, 215B and the receiving holes 62A, 62B formed close to the termination ends of the slide holes 61A, 61B engage with each other and are joined together, whereby the terminal member 200 is secured to the speaker frame 6. That is, the arms 212A, 212B of the terminal member 200 are fastened to the frame 6. At this point, the third claw 211A of the terminal member 200 engage with the third slide hole 63. That is, the central base 211 of the terminal member 200 is fastened to the frame 6.

After the terminal member 200 has been attached to the frame 6 as shown in FIG. 11, the projections 213 of the terminal member 200 project into the inside of the frame 6 and the terminal plates 220 and the connectors 230 are located outside the frame 6.

[Operations for Mounting the Lead Wire 300]

Next, a description will be given of the operations of fabricating the speaker apparatus 100, in particular the operations of connecting the lead wire 300 to the terminal member 200 and the voice coil bobbin 9, with reference to the accompanying drawings. For example, as shown in FIG. 3, when the lead wire 300 is mounted on the terminal member 200 which has been attached to the frame 6, the operator first inserts his hand into the frame 6 from the frame-opening 6*b* as shown in FIGS. 4 and 5, then simply inserts the end of the lead wire 300 into the through hole 214 from the direction of the insertion end on the protrusion 213, then draws the lead wire 300 through the through hole 214, and then fixedly joins it to the anchor 221 by solder or the like. That is, the necessity for performing a soldering operation inside the frame 6 is eliminated, resulting in an effective connection operation for the lead wire 300.

The present invention is not limited to the foregoing embodiment. For example, the terminal member 200 is attached to the flat portion 6A of the frame 6 in the present embodiment, but the point of attachment is not so limited. For reasons of design or the like, a slide hole may be formed in a desired position on the frame 6 for attachment.

The claw 215 is placed in a direction at an approximately right angle to the slide direction, but the direction is not so limited. For example, the claw 215 may be of a shape protruding in the slide direction.

The foregoing embodiment has described a speaker apparatus having a cone-shaped diaphragm, but is not so limited. The speaker apparatus may have a diaphragm of various shapes such as a cone shape, a dome shape, a circular shape, an elliptical shape, for example. The foregoing embodiment has described a speaker with a drive system which is driven by application of electric current, but the drive system is not so limited. For example, various drive systems such as an electromagnetic drive system, an electrostatic drive system or a piezoelectric drive system may be adopted. Regarding the type of the magnetic circuit, a magnetic circuit with a magnet placed on either the inner or outer side may be used.

As described above, the frame 6 has the slide holes 61, and the receiving holes 62 respectively bored close to the ends of the slide holes 61. The terminal member 200 has the protrusions 213 protruding from the face thereof making contact with the speaker frame 6, and the claws 215 protruding in a direction approximately at a right angle to the protruding direction of the protrusion 213. On each of the claws 215, the approximate-projection-shaped engaging portion 216 is formed for engaging with the receiving hole 62 formed close to the end of the slide hole 61. As a result, when, for example, the terminal member 200 is mounted on the frame 5, the protrusion 213 is slid along the slide hole 61 while being inserted into the slide hole 61, and then the receiving hole 62 bored close to the end of the slide hole 61 is fixedly engaged with the approximate-projection-shaped engaging portion 216 formed on the claw 215, thereby fastening the terminal member 200 to the speaker frame 6. In short, it is possible to provide a speaker apparatus equipped with a terminal member having a simple structure and improved in workability in the mounting process, and provide the terminal member.

Further, the terminal member 200 has the protrusions 213A, 213B respectively provided close to the both ends of the terminal member 200. The protrusion 213A includes the claw 215A protruding in a direction approximately perpendicular to the sliding direction of the terminal member 200, while the protrusion 213B includes the claw 215B protruding in the direction approximately opposite to the claw 215A. In consequence, the more reliable fastening of the terminal member 200 to the frame 6 is achieved.

On the other hand, the frame 6 has the slide holes 61A, 61B respectively bored in correspondence with the protrusions 213A, 213B. Then, the receiving holes 62A, 62B engaging with the claws 215A, 215B are respectively bored close to the ends of the slide holes 61A, 61B. In consequence, the more reliable fastening of the terminal member 200 to the frame 6 is achieved.

The terminal member 200 includes the third claw 211A protruding in an approximately middle position between the protrusions 213A, 213B from the face making contact with the speaker frame 6. The speaker frame 6 includes the third slide hole 63 engaging with the third claw 211A of the terminal member 200. The third claw 211A is engaged with the third slide hole 63, whereby the more reliable fastening of the terminal member 200 to the frame 6 is achieved The slide hole 61 of the frame 6 includes the first hole 611 shaped to engage with the protrusion 213 and the claw 215 of the terminal member 200, and the second hole 612 which connects with the first hole 611, has the long axis direction limited in the sliding direction of the terminal member 200 with the insertion of the protrusions 213, and has approximately the same width as that of the protrusion 213. The receiving hole 62 engaging with the claw 215 of the terminal member 200 is formed close to the end of the second hole 612. As a result, the terminal member 200 according to the present invention is capable of being inserted into the slide holes 61 and receiving holes 62 which are a simple structure provided on the frame 6, and being reliably fixed to the frame 6.

The terminal member 200 includes the approximately-tubular-shaped protrusions 213 having the through holes 214. The lead wire 300 connected at one end to the voice coil 10 inside the frame 6 and at the other end to the terminal member 200 placed outside the frame 6 is inserted through the through hole 214 and then is connected to the terminal member 200. As a result, the lead wire 300 can be simply mounted. Further, the lead wire 300 after having inserted through the tubular shaped protrusion 213 is fixed to the anchor 221. This design makes itpossibletopreventtheleadwire300 from falling. In addition, in the case of using the protrusion 213 formed of a flexible material, even if the lead wire 300 is subjected to stress or strong vibrations, the lead wire 300 can be prevented from being broken, thus maintaining the stable conductive state of the lead wire 300.

Further, the terminal member 200 in the present embodiment is constituted of the structural components molded integrally with each other by molding techniques such as injection molding, thus easily providing a terminal member 200 having protrusions 213, through holes 214, claws 215, engaging portions 216 and the like according to the present invention.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A speaker apparatus, comprising:

a speaker frame that has a slide hole and a receiving hole bored close to an end of the slide hole; and a terminal member, that is attached to the speaker frame, having a protrusion protruding from a contact face making contact with the speaker frame, and a claw protruding in a direction approximately at a right angle to a protruding direction of the protrusion, wherein the claw is provided with an engaging portion formed in an approximate projection shape to engage with the receiving hole formed close to the end of the slide hole.

2. A speaker apparatus according to claim 1, wherein after the protrusion is inserted into the slide hole, then is slid along the slide hole, the approximate-projection-shaped engaging portion formed on the claw fixedly engages with the receiving hole bored close to the end of the slide hole to fasten the terminal member to the speaker frame.

3. A speaker apparatus according to claim 2, wherein the terminal member has a first protrusion and a second protrusion respectively formed close to both ends of the terminal member, the first protrusion is provided with a first claw protruding in a direction approximately at a right angle to a slide direction, and the second protrusion is provided with a second claw protruding in a direction approximately opposite to the first claw.

4. A speaker apparatus according to claim 3, wherein the speaker frame has a first slide hole and a second slide hole respectively formed in correspondence to the first protrusion and the second protrusion, and the speaker frame has a first receiving hole and a second receiving hole respectively formed close to ends of the first and second slide holes to respectively engage with the first and second claws.

5. A speaker apparatus according to claim 4, wherein the terminal member is provided with a third claw formed in an approximately middle position between the first protrusion and the second protrusion and also protruding from the contact face making contact with the speaker frame, and the speaker frame is provided with a third slide hole engaging with the third claw of the terminal member.

6. A speaker apparatus according to claim 1, wherein the slide hole of the speaker frame is constituted of a first hole formed in a shape into which the protrusion and the claw of the terminal member are fitted, and a second hole, that connects to the first hole, having a long axis direction limited in a slide direction in which the terminal member with the protrusion inserted in the slide hole slides, and having approximately a same width as that of the protrusion, and the receiving hole of the speaker frame is formed close to an end to the second hole in order to engage with the claw of the terminal member.

7. A speaker apparatus according to claim 1, wherein the protrusion of the terminal member is formed in an approximately tubular shape and has a through hole formed therein, and a lead wire, which is to be connected at one end to a voice coil placed within the speaker frame and at the other end to the terminal member provided outside the speaker frame, is brought out through the through hole, and then connected to the terminal member.

8. A speaker apparatus according to claim 5, wherein the respective elements of the terminal member are molded integrally with each other.

9. A speaker apparatus according to claim 1, wherein the terminal member has a base member of an approximate flat-plate shape, a terminal plate made of a metal material and formed on the base member, and a connector electrically connected to the terminal plate.

10. A speaker apparatus according to claim 9, wherein the connector of the terminal member is constituted of a push terminal and is connectable to a speaker cable for sending an audio signal to the speaker apparatus.

11. A speaker apparatus according to claim 9, wherein the connector of the terminal member is constituted of a screw terminal.

* * * * *